US007378625B2

(12) United States Patent
Richardson et al.

(10) Patent No.: US 7,378,625 B2
(45) Date of Patent: May 27, 2008

(54) MICROWAVABLE METALLIC CONTAINER

(75) Inventors: Michael Richardson, Superior, CO (US); Jason Kaanta, Pine, CO (US); Vincent Hirsch, Boulder, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 11/064,224

(22) Filed: Feb. 22, 2005

(65) Prior Publication Data

US 2005/0199619 A1 Sep. 15, 2005

Related U.S. Application Data

(63) Continuation-in-part of application No. 10/797,749, filed on Mar. 9, 2004.

(51) Int. Cl.
*H05B 6/80* (2006.01)

(52) U.S. Cl. ..... 219/730; 219/729; 220/612

(58) Field of Classification Search ..... 219/725, 219/724, 736, 728, 732, 734, 730, 731; 99/DIG. 14; 426/107, 241, 243, 234; 220/258.2, 612, 220/359.1, 258.5, 359.2, 212.5, 212, 270, 220/276, 780, 574.1

See application file for complete search history.

(56) References Cited

U.S. PATENT DOCUMENTS

| | | | | |
|---|---|---|---|---|
| 3,219,460 | A | 11/1965 | Brown | |
| 3,379,358 | A | 4/1968 | Cvacho | |
| 3,547,305 | A * | 12/1970 | Khoury | 220/359.1 |
| 3,709,398 | A * | 1/1973 | Fuhrmann | 220/612 |
| 3,737,092 | A | 6/1973 | Rausing | |
| 3,854,023 | A | 12/1974 | Levinson | |
| 3,941,967 | A | 3/1976 | Sumi et al. | |
| 3,952,912 | A | 4/1976 | Perry | |
| 3,985,261 | A | 10/1976 | Kulesa | |
| 4,046,282 | A | 9/1977 | Ruch | |
| 4,081,646 | A | 3/1978 | Gottso | |
| 4,190,757 | A | 2/1980 | Turpin et al. | |
| 4,227,624 | A | 10/1980 | Hawkins | |
| 4,351,997 | A | 9/1982 | Mattisson et al. | |
| 4,388,335 | A | 6/1983 | Schiffmann et al. | |
| 4,438,850 | A | 3/1984 | Kahn | |
| 4,513,876 | A | 4/1985 | Buchner | |
| 4,558,198 | A | 12/1985 | Levendusky et al. | |
| 4,560,850 | A | 12/1985 | Levendusky et al. | |
| 4,637,543 | A | 1/1987 | Kiicherer | |
| 4,641,005 | A | 2/1987 | Seiferth | |
| 4,656,325 | A | 4/1987 | Keefer | |
| 4,689,458 | A | 8/1987 | Levendusky et al. | |
| RE32,739 | E | 8/1988 | Terands | |
| 4,814,568 | A | 3/1989 | Keefer | |
| 4,828,135 | A | 5/1989 | Kawakami et al. | |

(Continued)

FOREIGN PATENT DOCUMENTS

| | | |
|---|---|---|
| CN | 1085180 | 4/1994 |

(Continued)

*Primary Examiner*—Quang T Van
(74) *Attorney, Agent, or Firm*—Sheridan Ross P.C.

(57) ABSTRACT

The present invention describes an apparatus used in conjunction with a metallic container adapted for processing, storing and heating foodstuffs in a microwave oven, and more specifically, a substantially metallic stackable container with a microwavable transparent portion, metallic reinforcing member, and a selectively removable lid, wherein the same container can be used to store, ship, heat, and serve a foodstuff to a consumer.

16 Claims, 16 Drawing Sheets

U.S. PATENT DOCUMENTS

| | | | |
|---|---|---|---|
| 4,875,597 | A | 10/1989 | Saunders |
| 4,940,158 | A | 7/1990 | Farrell et al. |
| 4,988,013 | A | 1/1991 | Kobayashi et al. |
| 4,997,691 | A | 3/1991 | Parkinson |
| 5,022,551 | A | 6/1991 | Hexel |
| 5,108,387 | A | 4/1992 | Falk et al. |
| 5,230,914 | A | 7/1993 | Akervik |
| 5,246,134 | A | 9/1993 | Roth et al. |
| D345,081 | S | 3/1994 | Adami et al. |
| 5,725,120 | A | 3/1998 | Ramsey et al. |
| 5,900,264 | A | 5/1999 | Gics |
| 5,961,872 | A | 10/1999 | Simon et al. |
| 6,165,115 | A | 12/2000 | Rea |
| 6,213,328 | B1 | 4/2001 | Tiramani et al. |
| 6,508,375 | B1 | 1/2003 | Krall |

FOREIGN PATENT DOCUMENTS

| | | |
|---|---|---|
| CN | 1395899 | 2/2003 |
| CN | 1396098 | 2/2003 |
| DE | 41 24208 | 1/1993 |
| EP | 0344839 | 12/1989 |
| EP | 0487166 | 5/1992 |
| EP | 0875370 | 11/1998 |
| GB | 213 4495 | 8/1984 |
| JP | 05229558 | 9/1993 |
| JP | 05305935 | 11/1993 |
| JP | 08085546 | 4/1996 |
| JP | 2001247157 | 9/2001 |
| NZ | 0333393 | 4/2001 |
| WO | WO 9611142 | 4/1996 |
| WO | WO 0041935 | 7/2000 |
| WO | WO 2004033324 | 4/2004 |

* cited by examiner

MICROWAVABLE METALLIC CONTAINER

FIELD OF THE INVENTION

This Continuation-In-Part application claims priority of pending U.S. patent application Ser. No. 10/797,749, having a filing date of Mar. 9, 2004, the entire application being incorporated herein in its entirety by reference.

The present invention relates to food and beverage containers, and more specifically metallic containers used for perishable foodstuffs which can be heated in a microwave oven.

BACKGROUND OF THE INVENTION

With the introduction of the microwave oven, a huge demand has been created for disposable food and beverage containers which may be heated in conventional microwave ovens. These containers eliminate the necessity of utilizing a separate microwavable bowl and the inconvenience related thereto, and provide a container which is used for both storing food and beverage items, heating those items, and subsequently using the container as a serving bowl or tray. Following use, the microwavable bowl may be conveniently discarded or recycled rather than cleaned. As used herein, the term "foodstuffs" applies to both solid and liquid food and beverage items, including but not limited to pasteurized liquids such as milk products, soups, formula, and solids such as meats, vegetables, fruits, etc.

In general, metal containers have not been utilized for heating foodstuffs in microwave ovens due to the likelihood of electrical "arcing", and the general public misconception that metal materials are incapable of being used in conventional microwave ovens. Although previous attempts have been made to design microwavable metal containers, these products have generally been very limited and impractical in their design and use. For example, U.S. Pat. No. 4,558,198 and 4,4689,458 describe microwavable metal containers which have height limitation of less than about 1 inch, and are thus not practical for storing any significant volume of foodstuffs.

U.S. Pat. No. 5,961,872 to Simon et al, (the '872 patent") discloses a microwavable metal container which utilizes a microwavable transparent material. However, the '872 patent does not utilize a hermetic seal which is sufficient to safely store food items under a vacuum for long periods of time, and which requires that the entire lower portion and sidewall of the metal container be enclosed within an electrical insulation material to prevent arcing. Further, the device requires that the side walls of the container have a height less than about 40 percent of the wavelength of the microwave radiation used to heat the object, which is not overly practical or functional.

More recent attempts to store and cook food in microwavable containers have been accomplished by using non-metallic plastic and foam type materials. Although these products are suitable for use in microwave ovens, and are generally accepted by the consuming public, they have numerous disadvantages when compared to metallic containers. More specifically, non-metallic foam and plastic containers have very poor heat transfer characteristics, and these types of containers require significant more time to heat and cool in a food processing plant. Thus, these types of containers are very time-consuming and expensive to fill and sterilize during filling operations, and are thus inefficient for mass production.

Further, non-metallic containers are not as rigid as metal containers, and thus cannot be stacked as high as metal containers which limits the volume which can be shipped, and thus increases expenses. Additionally, non-metallic containers are not durable, and are prone to damage and leaking during shipment and placement for sales, thus adding additional expense. Furthermore, multi layer barrier plastics and foams are generally not recyclable like metal containers, which fill landfills and are thus not environmentally friendly.

Additionally, most conventional foam containers are not durable and susceptible to damage when subjected to high heat such as that found during a retort operation wherein a foodstuff in a container is sterilized with steam or other means.

Finally, foodstuffs cooked in non-metallic plastic and foam containers in a microwave oven generally overheat and burn next to the container surface, while the foodstuff in the center of the container heats last, and thus requires stirring for adequate heating. Further, there are general health concerns regarding the possible scalping of chemicals and the subsequent altered taste when cooking foods in non-metallic containers, especially since non-metallic plastics and foams can melt and deform when overheated.

Thus, there is a significant need in the food and beverage container industry to provide an economical metallic container which may be used for cooking foodstuffs in a microwave oven and which eliminate many of the health, shipping and filling problems described above.

SUMMARY OF THE INVENTION

It is thus one aspect of the present invention to provide a metallic, microwavable metal container which is hermetically sealed and capable of storing foodstuffs for long periods of time. Thus, in one embodiment of the present invention, a metallic container is provided with a lower end of a sidewall sealed to a non-metallic microwavable transparent material. Preferably, the microwavable transparent material and sidewall are double seamed to a reinforcing material and may additionally utilize a sealant material to create a hermetic, long lasting, airtight seal.

It is a further aspect of the present invention to provide a microwavable metal container which generally heats foodstuffs contained therein from the "inside out", rather than the "outside in" as found with conventional plastic and foam containers. Thus, in one embodiment of the present invention a container with a unique geometric shape is provided, and while the microwavably transparent material on the lower end of the container has a surface area of at least about 1.25 square inches. More specifically, the metallic container in one embodiment has an upper portion with a greater diameter than a lower portion of the container, and thus has a substantially conical geometric shape which facilitates efficient cooking of the foodstuffs contained therein.

It is a further aspect of the present invention to provide a microwavable metallic container which utilizes well known materials and manufacturing processes which are well accepted by both the container industry and consumers alike. Thus, in one aspect of the present invention a microwavable metallic container is provided which is compiled of steel, aluminum, tin-coated steel, and which utilizes a microwavable transparent material comprised of materials such as polypropylene/EVOH, polyethylene, polypropylene and other similar materials well known in the art. Furthermore, the microwavably transparent material may be interconnected to the sidewall of the metallic container with a metallic or plastic reinforcing member by a double seaming process that is well known in the metallic container manufacturing industry, and which is capable of interconnecting multiple layers of materials. Alternatively, or in conjunction with the double seaming process the microwavable transparent material maybe welded or chemically adhered to a flange portion of the container sidewall or reinforcing member.

Alternatively, it is another aspect of the present invention to provide a microwavable metallic container which utilizes a microwavable transparent material which is welded or chemically sealed to a lower end of the metallic container sidewall. Thus, in one embodiment of the present invention there is no double seaming required to interconnect the metallic container sidewall to the microwavable transparent material, nor is a reinforcing member necessary for support since sufficient rigidity is obtained with the metallic sidewall and microwavable transparent bottom portion.

It is another aspect of the present invention to provide a substantially metallic microwave compatible container with a visible tamper indicator. Accordingly, in one embodiment of the present invention a deflectable disc or other shape is provided in the container or end closure which changes shape when the internal pressure in the container changes, thus identifying the pressure of a bacteria or the introduction of oxygen.

It is another aspect of the present invention to provide a bowl or container shape which is more efficient with regard to heating the foodstuffs within the container. Thus, in one aspect of the present invention a container is provided which utilizes an upper portion with a greater diameter than a lower portion, or alternative a lower portion with a greater diameter than an upper portion. Alternatively, a container which has an upper portion with substantially the same diameter upper portion and lower portion may be utilized.

Thus, in one aspect of the present invention, a method for processing and storing a foodstuff in a substantially metal container and subsequently heating the foodstuff in a microwave oven, and which comprises:

providing a container comprising an end closure, a bottom portion and a metal sidewall positioned therebetween, said bottom portion further comprising a microwave transparent portion;

filling said container with a foodstuff;

sealing said end closure to said metal sidewall to create a substantially airtight seal;

providing energy to said foodstuff to elevate the temperature of said foodstuff;

storing the foodstuff in said container in a substantially hermetically sealed condition;

removing said end closure of said container; and providing microwave energy to said foodstuff in the microwave oven to provide a preferred temperature prior to consumption by an end user.

Thus, in this embodiment of the present invention the same container can be used for storing, treating, shipping and subsequently heating a foodstuff.

It is a further aspect of the present invention to provide a method for processing and storing a foodstuff in a stackable, substantially metal microwavable container, comprising:

providing an edible foodstuff;

providing a container comprised of a bottom portion interconnected to metal sidewalls, said bottom portion further comprising a microwave transparent material;

filling said substantially metal container with a predetermined portion of the edible foodstuff;

interconnecting an end closure to an upper end of said metal sidewalls, wherein said substantially metal microwavable container is substantially sealed in an anaerobic condition;

providing energy to said substantially metal microwavable container and the edible foodstuff to elevate the temperature of said edible foodstuff to a predetermined level; and stacking a plurality of said substantially metal containers to a predetermined height of at least about 4 feet to optimize space prior to delivery of said stackable, substantially metal microwavable container to a distribution center.

Thus, in this embodiment of the present invention a microwavable metal bowl is provided which can be stacked to significant heights for storage and transportation and which has a high compressive strength.

It is a further aspect of the present invention to provide a metallic ring adapted for double seaming to a lower end of a metal sidewall of a microwave compatible container, the metallic ring comprising:

an outer panel wall extending downwardly from said first end;

an inner panel wall having an upper end and a lower end, said lower end interconnected to said outer panel wall to define a substantially u-shaped countersink; and a ring second end interconnected to said inner panel wall and extending inwardly, said ring second end having an upper surface and a lower surface, said upper surface adapted for interconnection to the microwave transparent material.

Thus, in one embodiment of the present invention the metallic ring is used to interconnect the metallic sidewall to the microwave transparent bottom portion. Alternatively, the metal ring can be eliminated entirely.

It is a further aspect of the present invention to provide a process for elevating the temperature of a foodstuff from an interior-most portion of a substantially metal container in a microwave oven, comprising:

providing a container comprising an end closure, a bottom portion and metallic sidewalls extending therebetween;

providing a microwave transparent material in at least a portion of said bottom portion to receive a microwave energy from the microwave oven;

providing a foodstuff in said substantially metal container which is in contact with at least an interior surface of said metallic sidewalls and an interior surface of said microwave transparent material; and providing microwave energy to said foodstuff in the microwave oven upon removal of the end closure, wherein the microwave energy travels at least in part through said microwave transparent material and reflects off of said interior surface of said metallic sidewalls, wherein the temperature of the foodstuff is elevated at an interior most portion of said substantially metal container faster than near said metallic sidewalls.

Thus, in this embodiment of the present invention, a microwavable metal container is provided which is more efficient than a traditional microwavable container for heating the foodstuff, and which elevates the temperature from an interior most portion of the container first.

It is a further aspect of the present invention to provide a method for manufacturing a container with a metallic sidewall which is adapted for use in a microwave oven, comprising:

providing a substantially planar metallic material having an upper edge, a lower edge and sidewalls interconnected thereto;

forming a substantially cylindrical shaped enclosure from said substantially planar metallic material;

interconnecting the sidewalls of the substantially cylindrical shaped enclosure to substantially retain a preferred shape;

providing a bottom portion comprising a microwavable transparent material;

interconnecting said bottom portion to a lower end of said substantially cylindrical shaped enclosure;

providing an end closure; and interconnecting said end closure to an upper end of said substantially cylindrical shaped enclosure.

Thus, in this embodiment of the present invention, a method of manufacturing a microwavable container is provided, and which utilizes metallic materials at least partially on the sidewalls, and which encompasses commonly known manufacturing equipment well known in the metal container manufacturing business.

DETAILED DESCRIPTION

Figure 1:
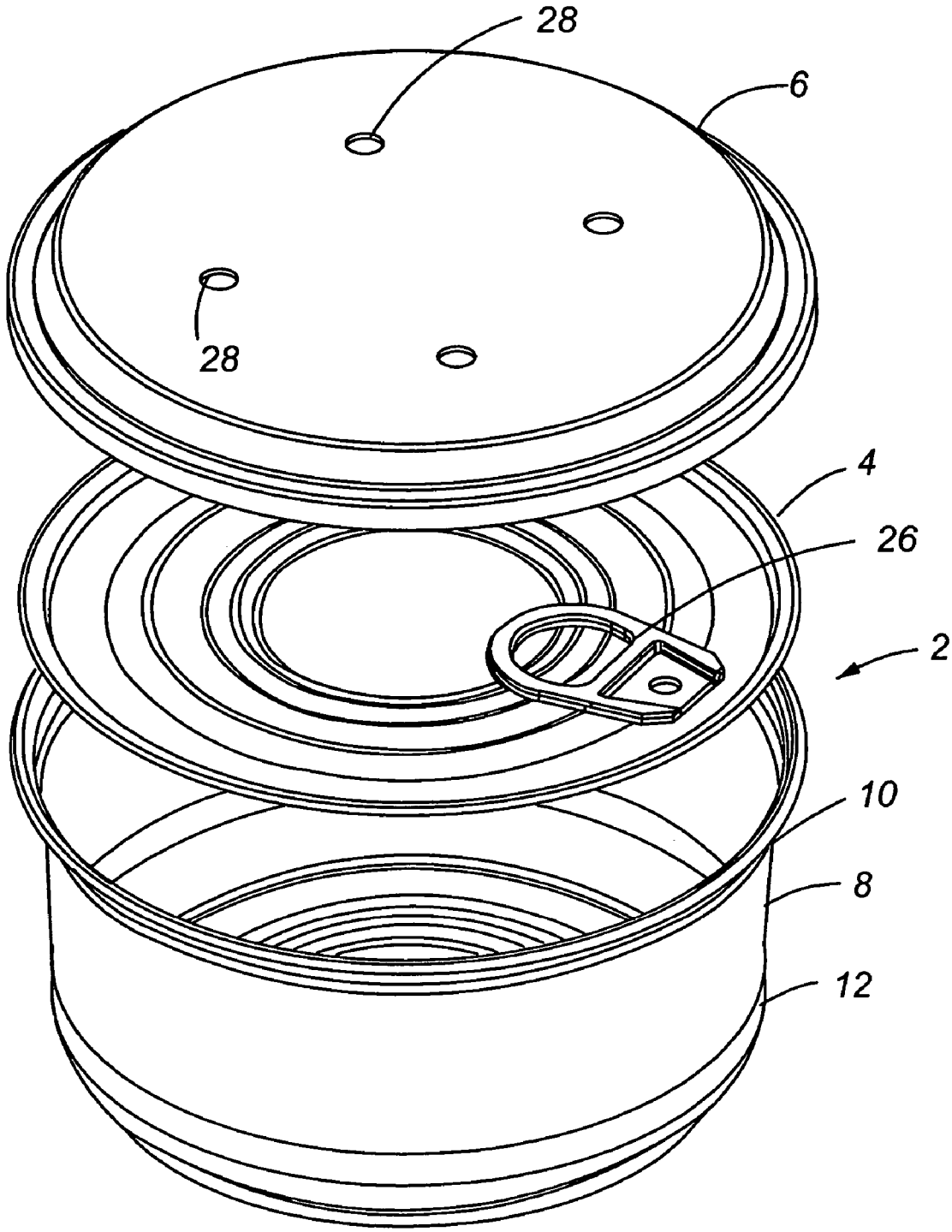
FIG. 1 is a front exploded perspective view of a metallic microwavable bowl.

Referring now to the drawings, FIGS. 1-11 depict various embodiments of a metallic microwavable bowl. Referring now to FIG. 1, a microwavable container 2 of the present invention is provided in an exploded view, and which identifies a metal lid 4 with interconnected pull tab 26, as well as a removable plastic lid 6 which is positioned thereon. In use, the metal lid 4 is hermetically sealed to the metallic side wall upper portion 10 of the container after the foodstuff is placed in the container during filling operations. During use, the metal lid 4 is removed from the metallic sidewall 8, and the removable plastic lid 6 is positioned on an upper end of the metallic side wall 8, to prevent splattering and to improve the heating of the foodstuff contained in the microwavable container 2.

As appreciated by one skilled in the art, since the container in one embodiment has a metal sidewall, it is capable of being stacked to greater heights due to the compressive strength. More specifically, the container in one embodiment has a compressive strength of at least 100 lbs. and filled containers may be stacked to a height of at least about 4 feet, and preferably 6-12 feet. Alternatively, in one embodiment the sidewalls may be comprised of an expandable material such as plastic, polyethylene, polyvinyl or other materials known in the art with accordion type features, and which may expand and contract due to temperature variations, retort operations and other conditions which may alter the internal pressure of the container.

Figure 2:
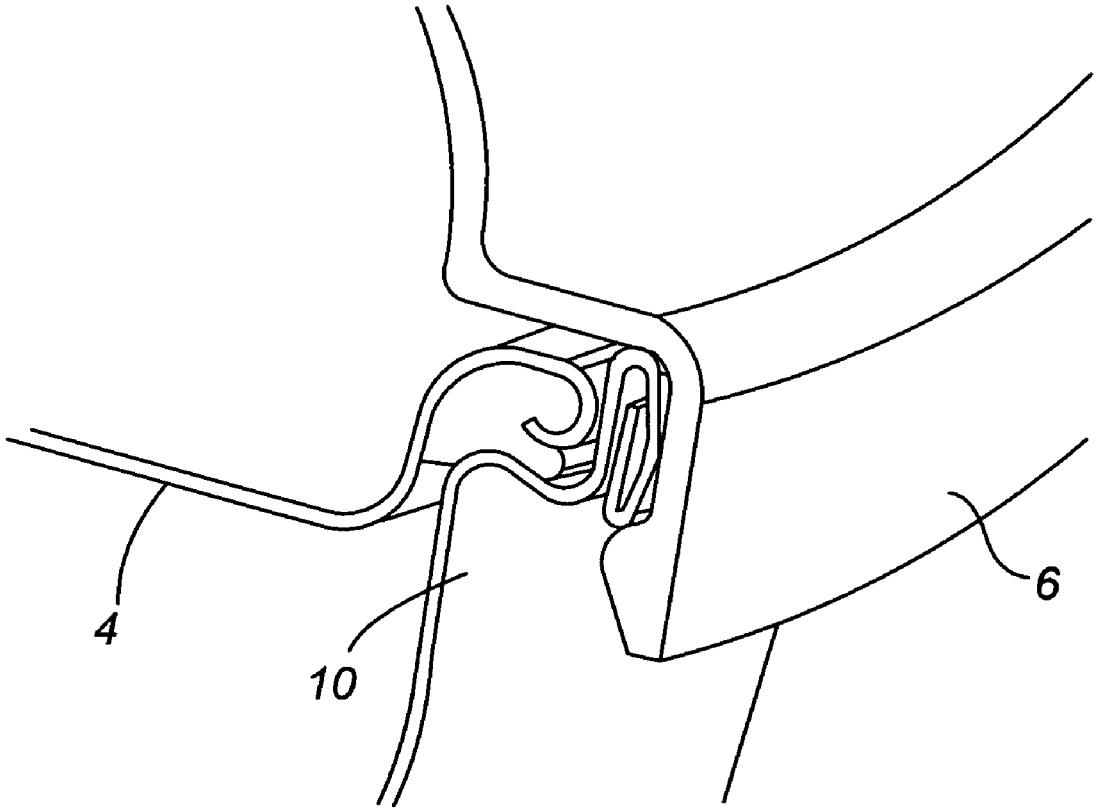
FIG. 2 is a front perspective view of the lid configuration of the embodiment shown in FIG. 1.

Referring now to FIG. 2, a detailed drawing of the upper portion of one embodiment of the microwavable container 2 is provided herein and which depicts the interconnection of the metal lid 4 which is used in conjunction with a sealant material 20, and further identifying a seam with a lower lip used to retain the removable plastic lid 6. Alternatively, the metal lid 4 is interconnected to the metallic side wall upper portion by a conventional double seam commonly used in the container manufacturing industry.

Figure 3:
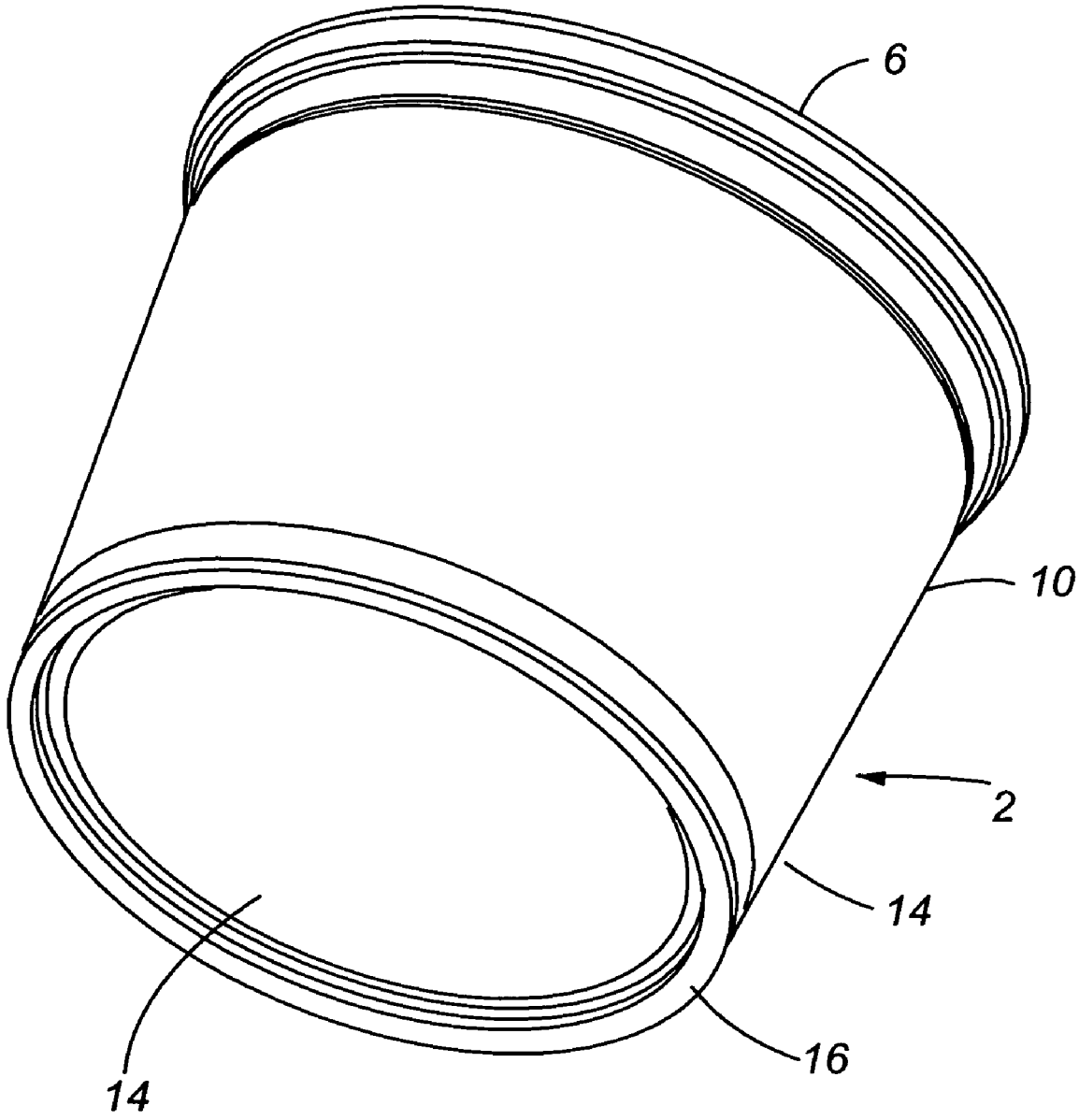
FIG. 3 is a bottom perspective view of one embodiment of the invention identified in FIG. 1, and identifying a metallic microwavable bowl with a microwavable transparent material on a bottom portion.

Referring now to FIG. 3, the microwavable container 2 of FIG. 1 is provided herein as viewed from a bottom perspective view. More specifically, the microwavable container 2 comprises a metallic side wall 8 which includes a sidewall upper portion 10, a metallic sidewall lower portion 12, and a reinforcing member 16 which is used to interconnect the microwavable transparent bottom portion 14 to the metallic sidewall 8. In one embodiment of the present invention the microwavable transparent material is comprised of a polyethylene or a polypropylene/EVOH, nylon, PET or other plastics, and as appreciated by one skilled in the art can comprise any number of materials which allow the passing of microwavable energy.

Furthermore, in a preferred embodiment of the present invention, the microwavable transparent bottom portion 14 has a cross sectional area of at least about 1.25 square inches, to allow optimum heating of the foodstuff contained within the microwavable container 2. The bottom reinforcing member 16 is used for interconnecting the metallic sidewall lower portion 12 to the microwavable transparent bottom portion 14, and is generally comprised of a metal material such as aluminum, or steel. However, as appreciated by one skilled in the art this material may also be comprised of a plastic material such as polypropylene, polyethylene or other well known materials in the art.

Figure 4:
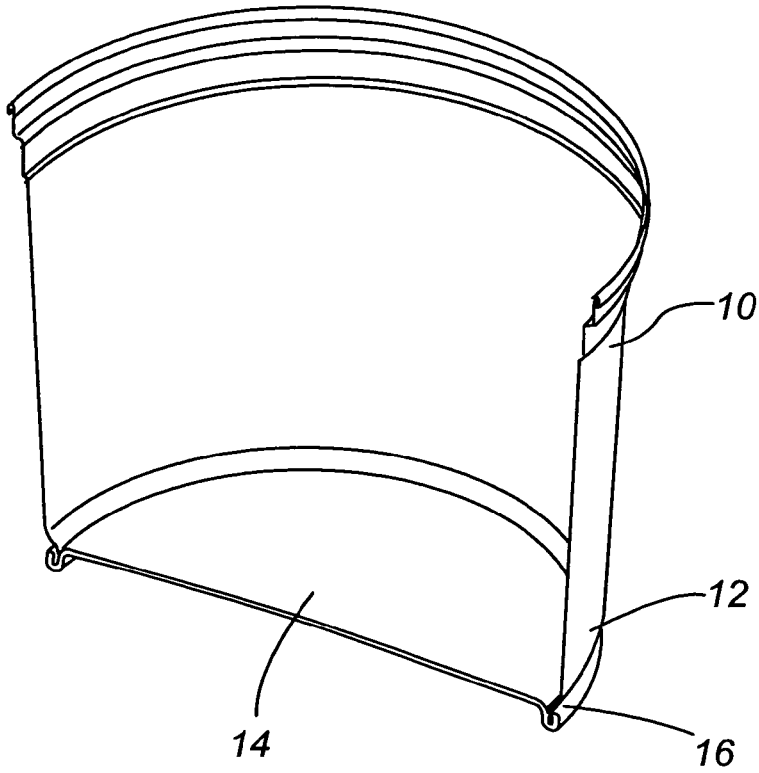
FIG. 4 is a cross-sectional view of the container shown in FIG. 1.
Figure 5A:
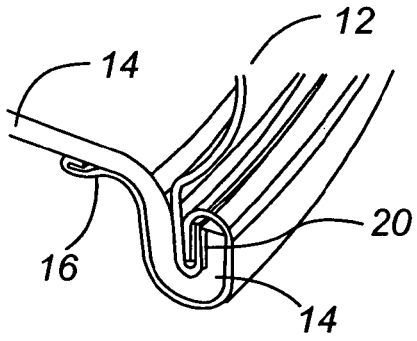
FIG. 5*a* is a front cut-away perspective view of the lower portion of the metal microwavable bowl shown in FIG. 4, and identifying the various components therein.
Figure 5B:
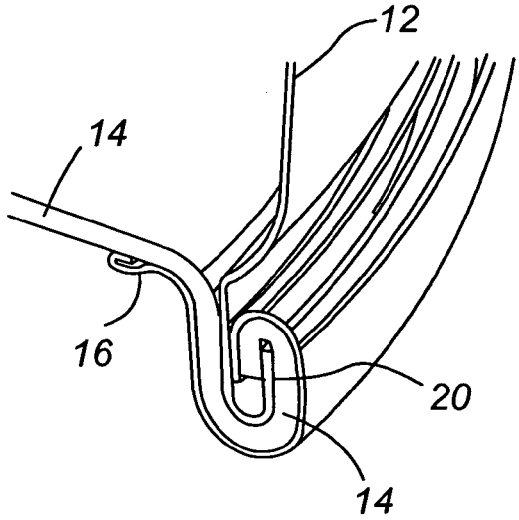
FIG. 5*b* is an enlarged view of the container shown in FIG. 5*a*.

Referring now to FIG. 4, a cut-away sectional view of one embodiment of a microwavable container 2 is provided herein, and depicts additional detail of the double seam used to interconnect the microwavable transparent bottom portion 14 to the metallic sidewall lower portion 12 and the bottom reinforcing member 16 as further provided in FIG. 5. As shown in FIG. 5, a conventional double seam 30 is used in one embodiment of the present invention and which efficiently interconnects the bottom reinforcing member 16 to the peripheral edge of a microwavable transparent material 18 and to a lower portion of the metallic sidewall 12. Additionally, a sealant material 20 may be positioned between at least 2 of either the metallic sidewall lower portion 12, the microwavable transparent material 18, or the bottom reinforcing member 16 to improve and assure the hermetic seal of the microwavable container 2. Preferably the sealant is comprised of an elastomer, a silicon or a latex based material.

Figure 6:
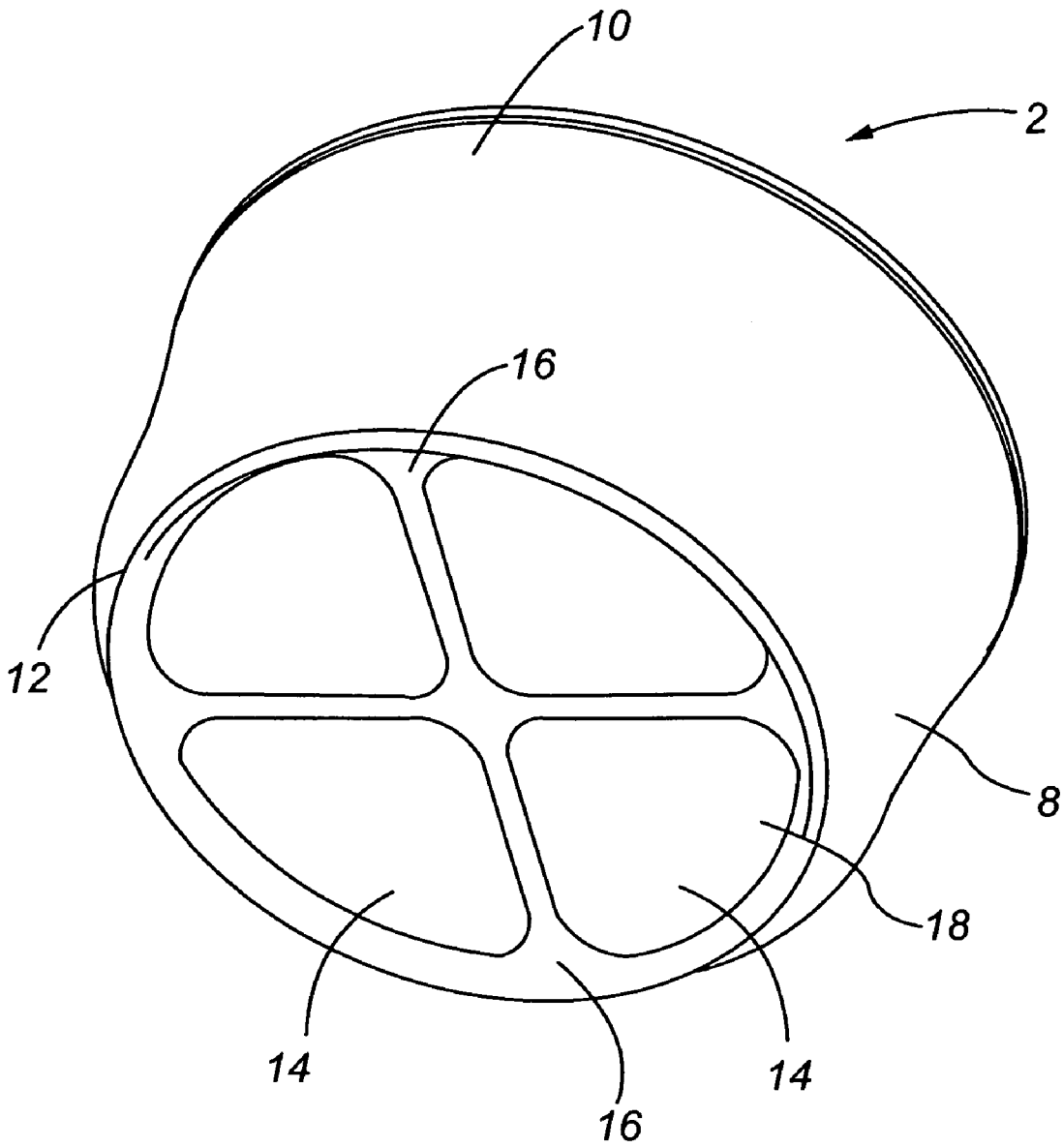
FIG. 6 is a bottom perspective view of an alternative embodiment of the present invention.

Referring now to FIG. 6, an alternative embodiment of the present invention is provided herein which depicts a bottom perspective view of a microwavable container 2 which utilizes an alternative geometric pattern for the microwavable transparent material 18. Although in this embodiment additional rigidity is provided with the bottom reinforcing member 16, and which creates 4 individual pieces of the microwavable transparent material 18, any variety of geometric shapes and configurations may be used as appreciated by one skilled in the art. Preferably, and as stated above, the microwavable transparent material 18 has a surface area sufficient to efficiently heat the foodstuffs contained within the microwavable container 2, and thus is preferably at least about 1.25 square inches, and more preferably about 3.0 square inches.

Furthermore, and again referring to FIG. 6, the upper portion of the container 2 has a greater diameter than a lower portion, which appears to have superior heating qualities when compared with a traditional food container with a generally cylindrical shape. Alternatively, the lower portion of the container 2 may be designed to have a larger diameter than an upper portion of the container, or a generally cylindrical shape may be utilized.

Figure 7:
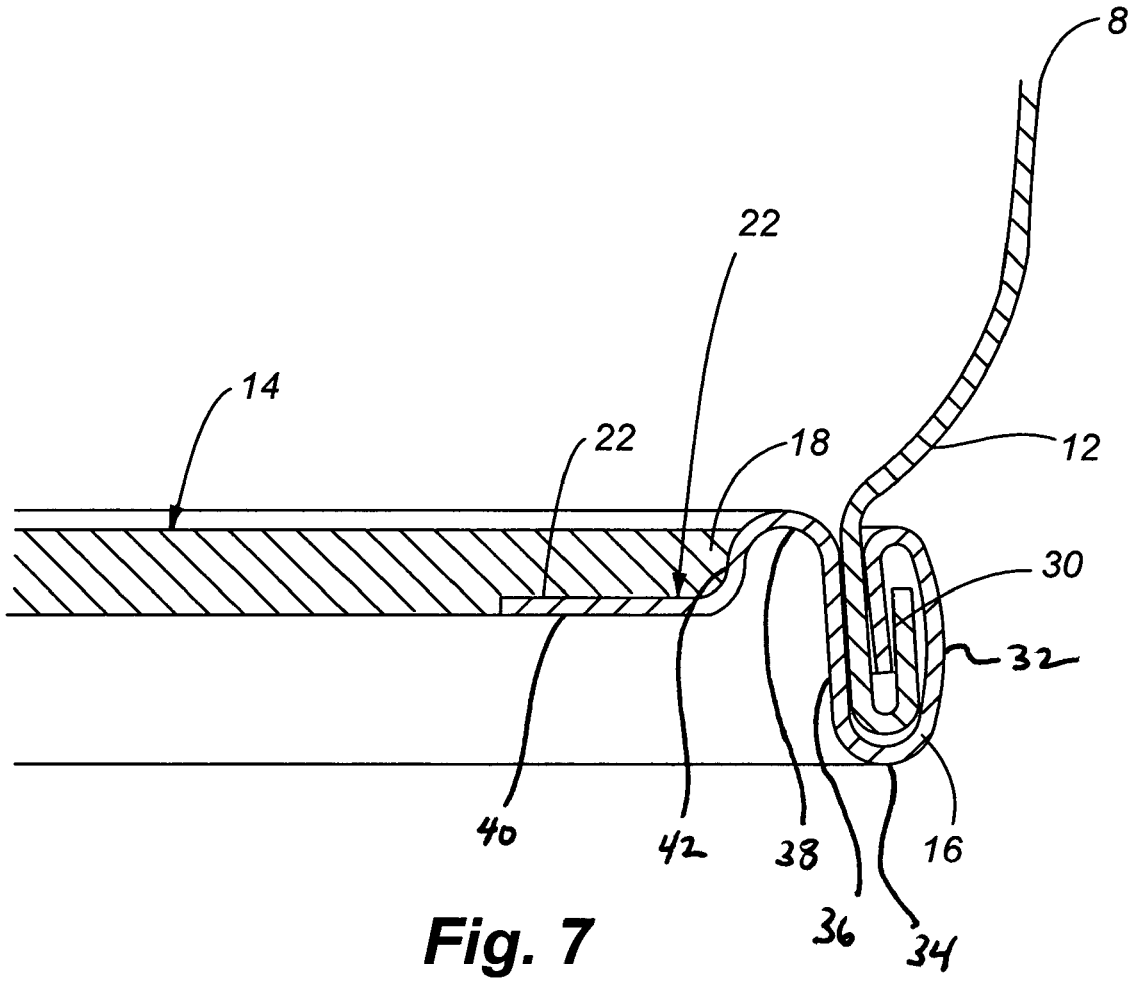
FIG. 7 is a cross-sectional front elevation view depicting an alternative embodiment of a lower portion of the present invention.
Figure 8:
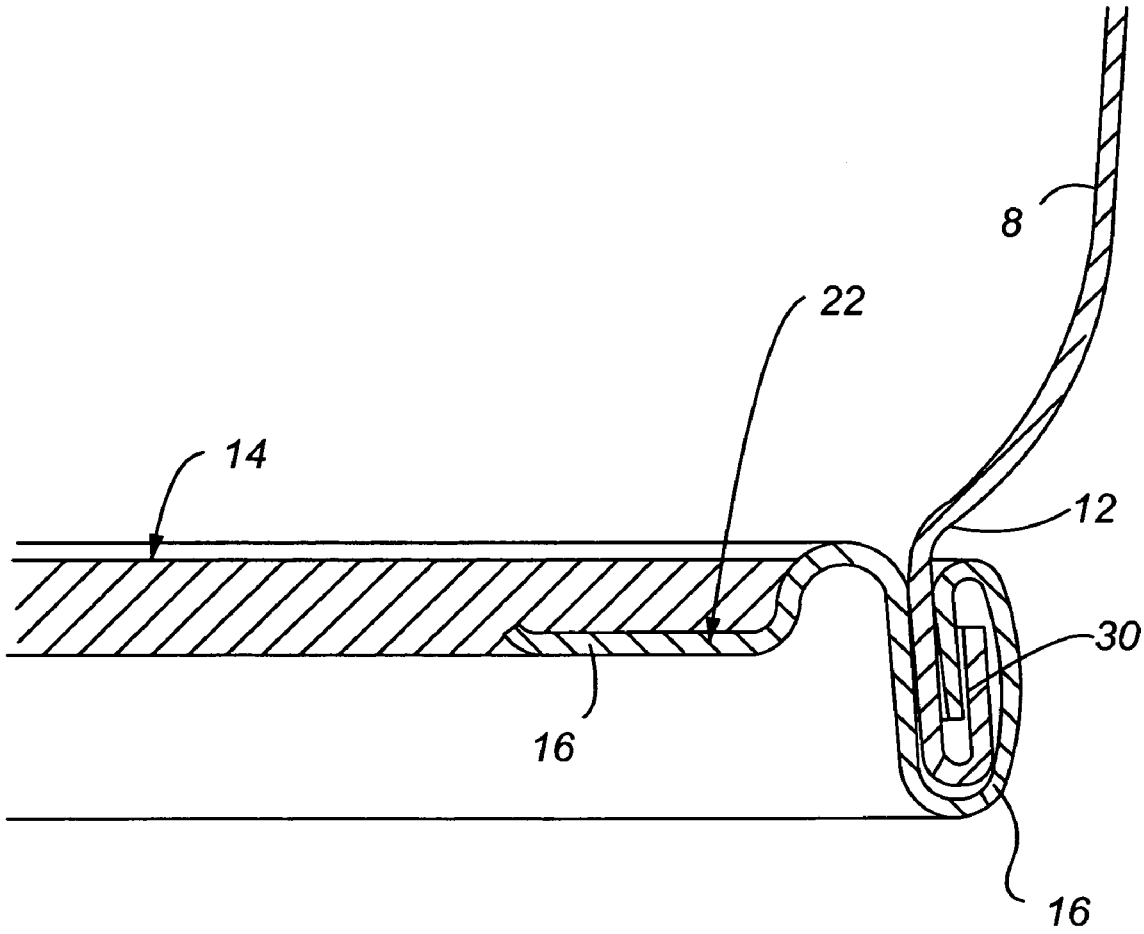
FIG. 8 is a cross-sectional front elevation view of an alternative embodiment of a lower portion of a metal microwavable bowl.
Figure 9:
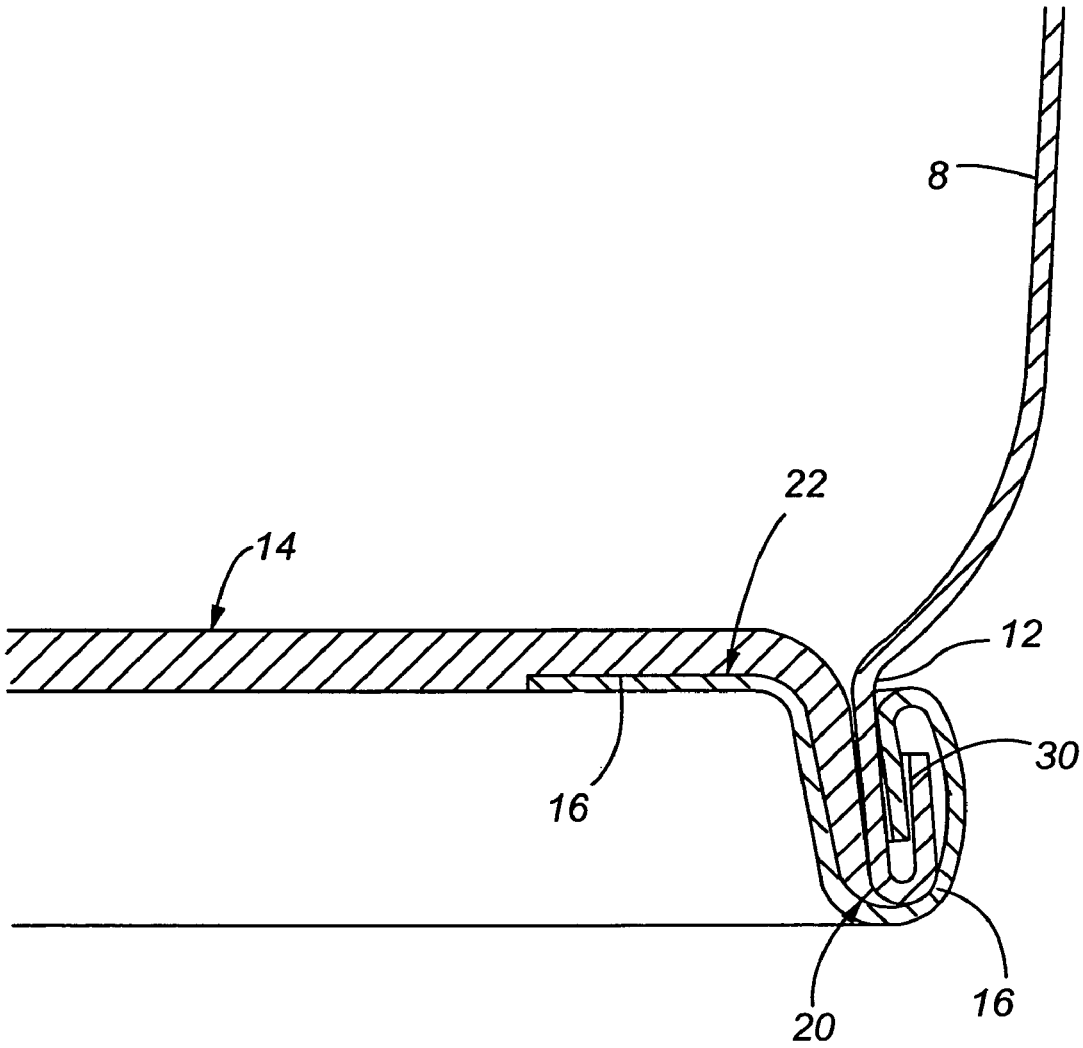
FIG. 9 is a cross-sectional front elevation view of a lower portion of a metal microwavable bowl, and identifying an alternative embodiment.

Referring now to FIGS. 7-11, sectional front elevation views of a lower portion of alternative embodiments of a microwavable container 2 are provided herein. More specifically, various embodiments are provided herein which show the interconnection of the microwavable transparent material 18, the bottom reinforcing member 16, and the lower portion of the sidewall 12. More specifically, as shown in FIG. 7, a weld 22 is provided which effectively interconnects the microwavable transparent material 18 to the bottom reinforcing member 16 along an upper edge of the bottom reinforcing material 16. As shown in FIG. 8, the weld 22 in this embodiment extends over a portion of the bottom reinforcing member 16 and along a portion of the bottom edge. Referring now to FIG. 9, yet another embodiment of the seal between the microwavable transparent material 18 and the bottom reinforcing member 16 is shown herein and wherein the weld 22 extends downwardly along the bottom reinforcing member 16 in a slightly different configuration.

Figure 10:
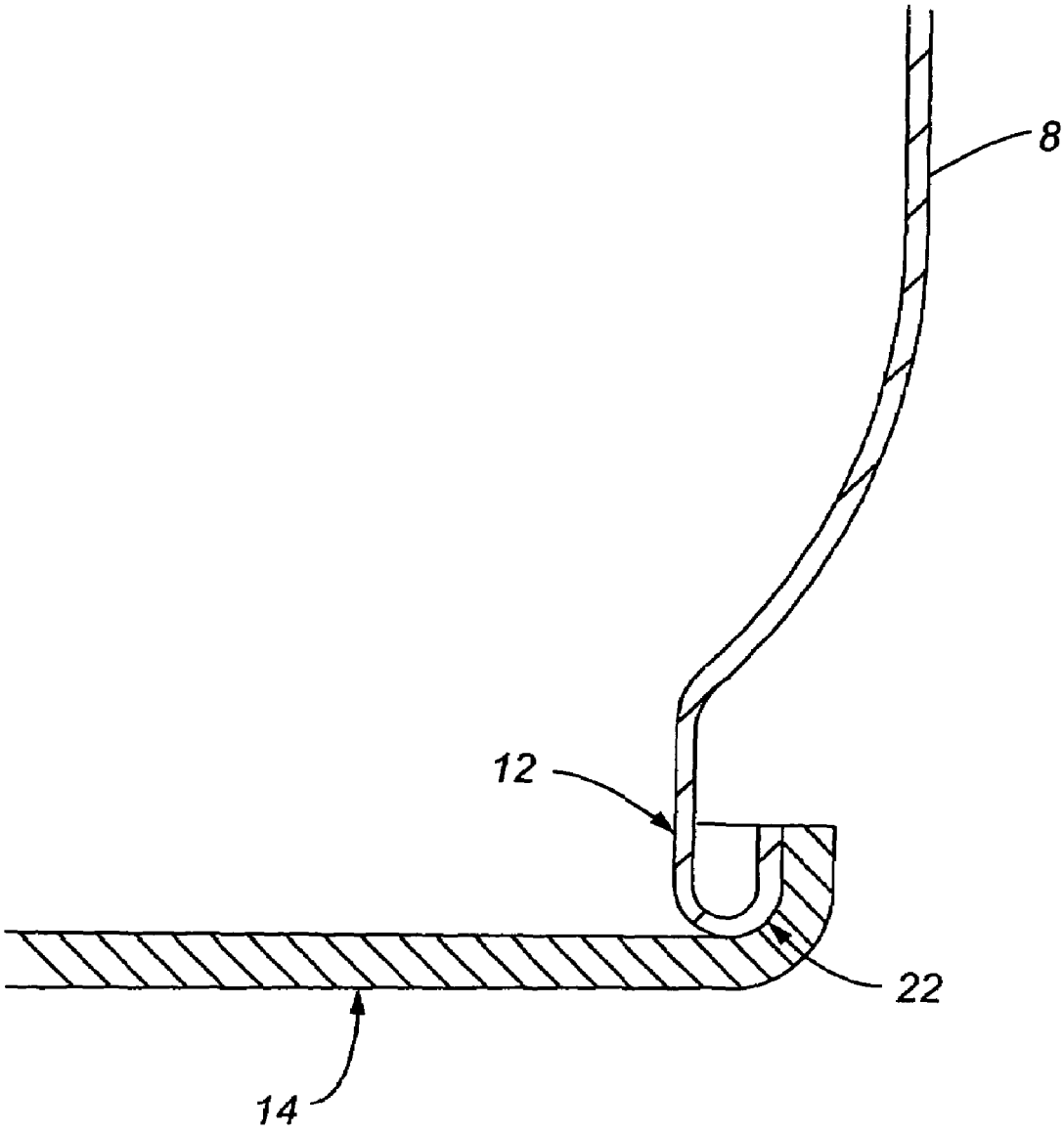
FIG. 10 is a cross-sectional front elevation view of a lower portion of a metal microwavable bowl and identifying an alternative embodiment.
Figure 11:
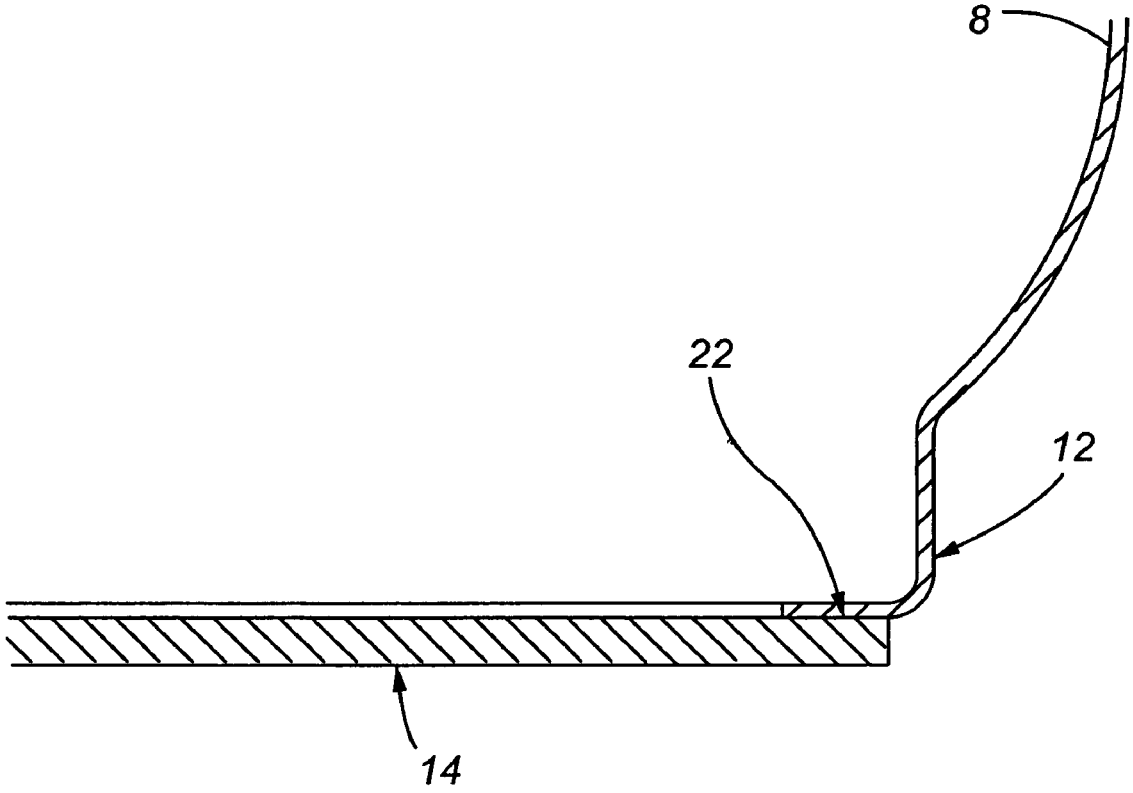
FIG. 11 is a cross-sectional front elevation view of a lower portion of a metal microwavable bowl, and identifying an alternative embodiment.

Referring now to FIGS. 10-11, two alternative embodiments of the present invention are provided, wherein a double seam is not utilized to interconnect the microwavable transparent material 14 to a lower portion of the container sidewall 12. Rather, in both of the embodiments depicted in FIG. 10 and FIG. 11, the microwavable container 2 rests completely on the microwavable transparent material 14, and there is no requirement for a bottom reinforcing material 16 or an attachment ring. More specifically, the lower portion of the container sidewall 12 is merely welded 22 directly to the microwavable transparent material 14 to create an airtight seal, thus eliminating entirely the requirement for the reinforcing material 156 and the step of double seaming these materials together. Further, based on the inherent rigidity of the metallic sidewall 12 and microwavable transparent material 18, there is no need of the bottom reinforcing member 16, and thus a significant cost savings.

In an alternate embodiment of the present invention a microwavable container is provided which is comprised of a microwave transparent sidewalls and having a metal end closure and a microwave transparent bottom portion. Alternatively, both the bottom portions and end closure are comprised of a metallic material. During use, the metallic end closure is removed, and microwave energy travels through at least one of the side-walls of the container, the upper portion of the container, and a lower portion of the container.

Although each of the geometric configurations provided in FIGS. 7-11 have proven to be effective, numerous other variations may be provided as appreciated by one skilled in the art and which may be dictated by preferred geometric shapes, material costs, and/or manufacturing concerns.

Figure 12:
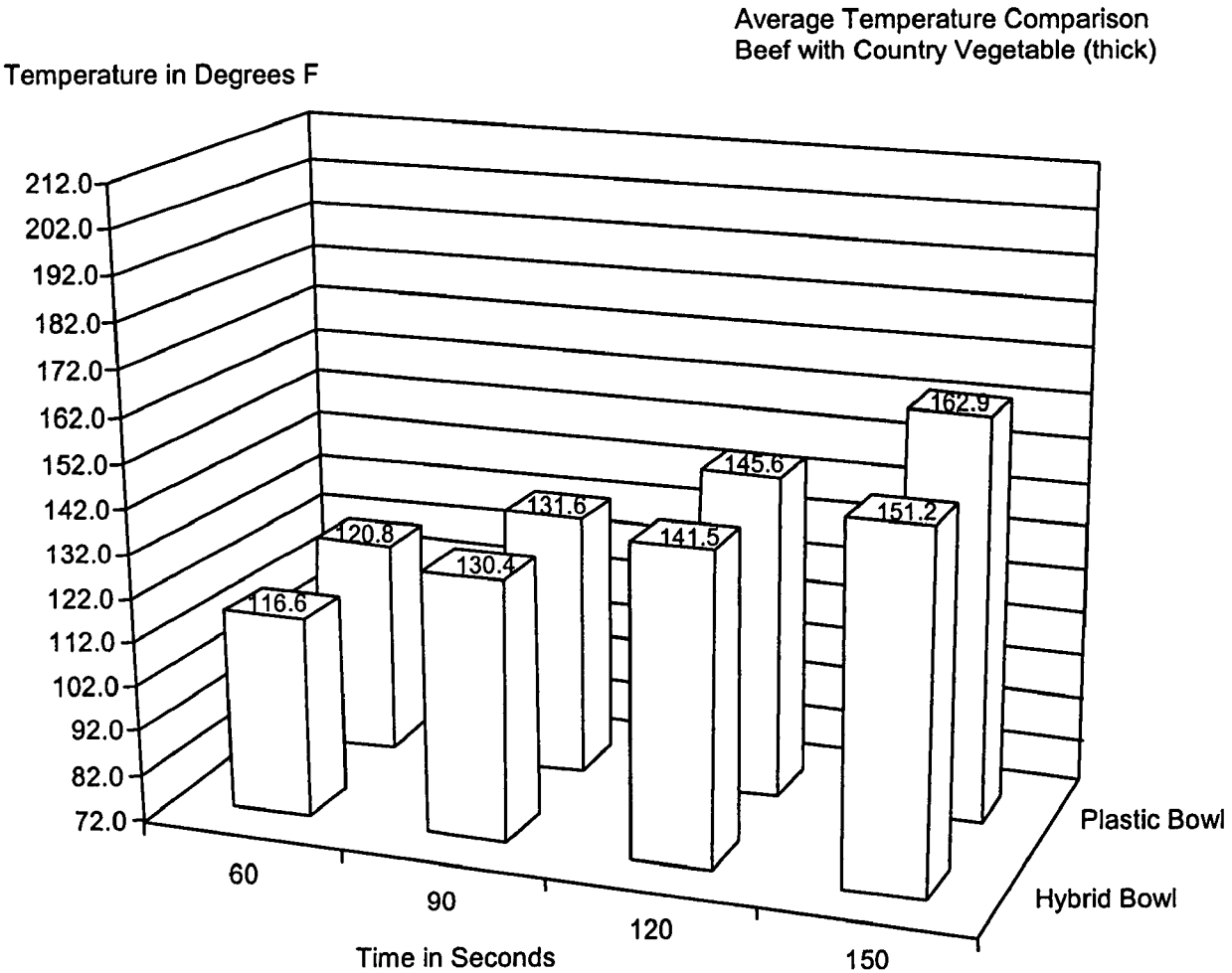
FIG. 12 is a bar graph identifying the average temperature comparison of a soup heated in the hybrid bowl of the present invention, as compared to a typical microwavable plastic bowl.
Figure 13:
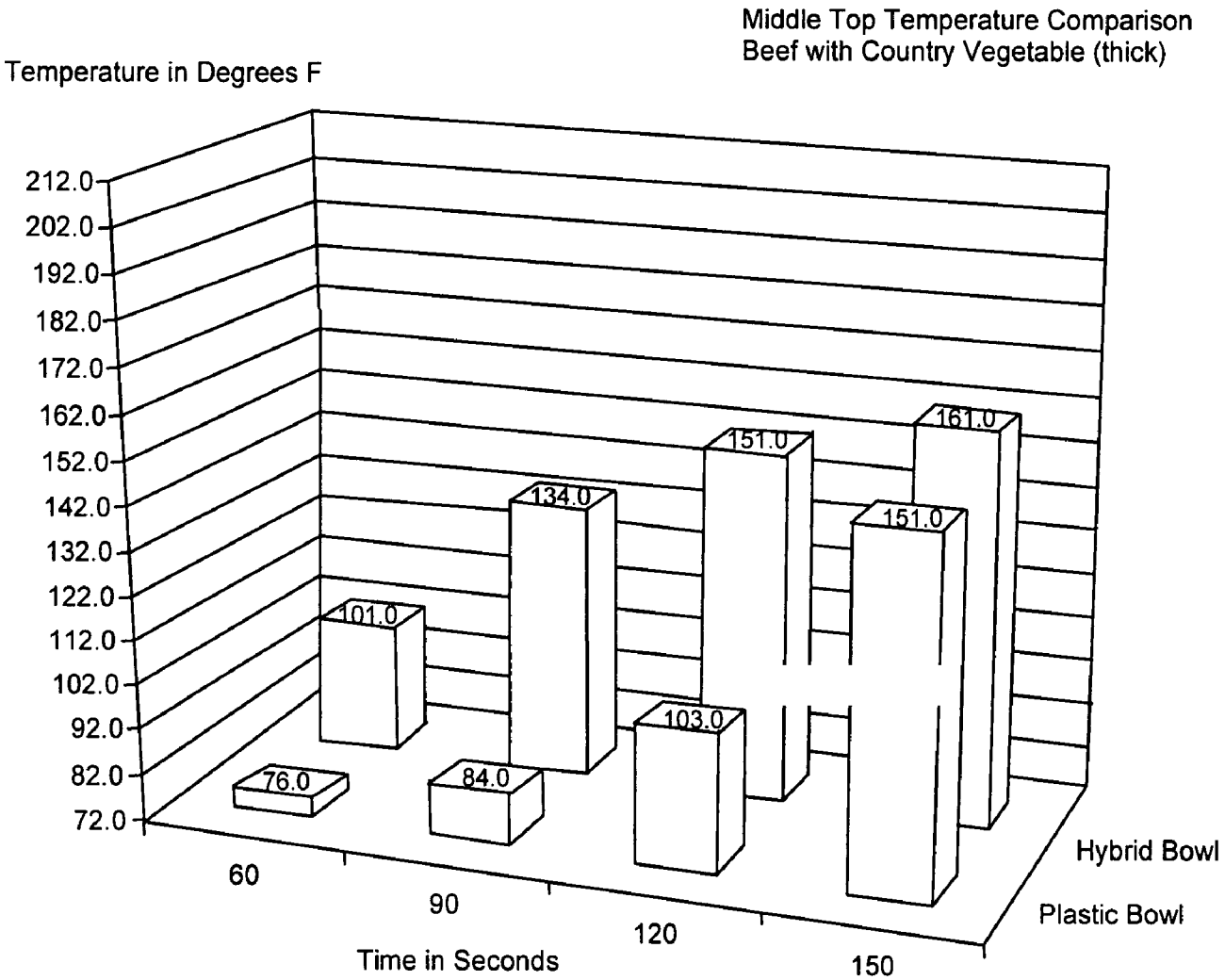
FIG. 13 is a bar graph identifying the middle top temperature of a soup material heated in a conventional plastic bowl, and the hybrid bowl of the present invention.
Figure 14:
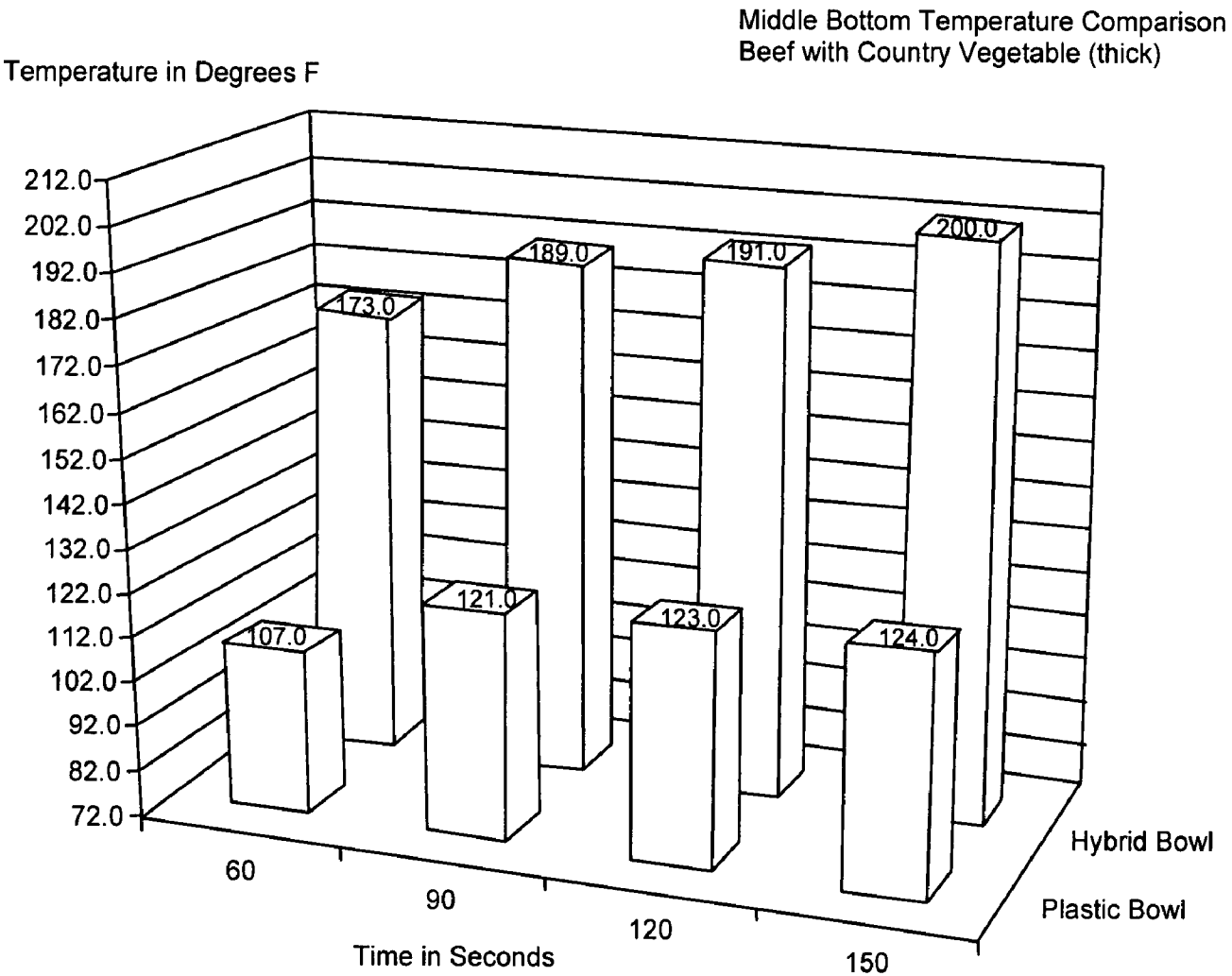
FIG. 14 is a bar graph identifying the middle bottom temperature of a soup cooked in the microwavable hybrid bowl of the present invention as compared to a conventional plastic bowl.
Figure 15:
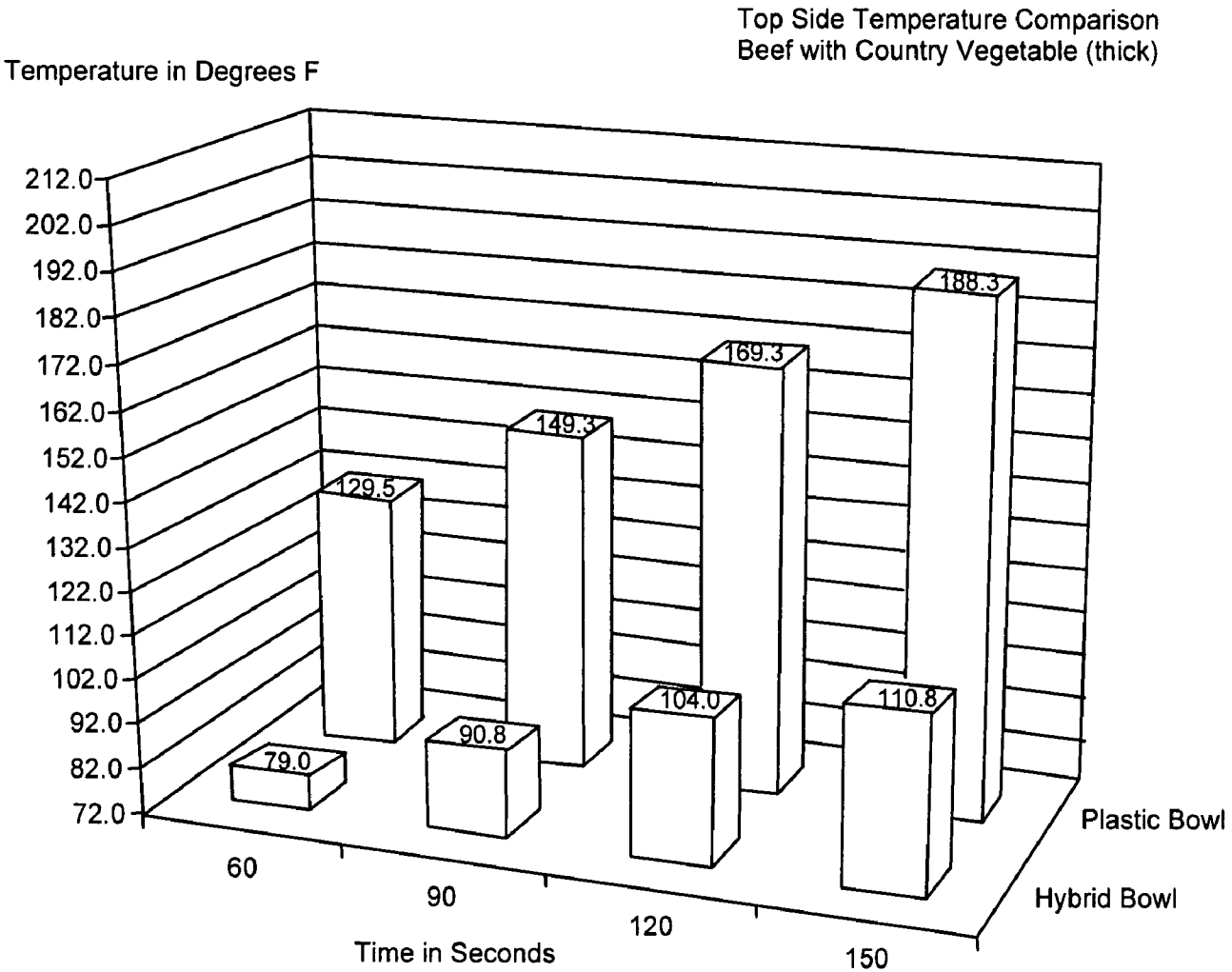
FIG. 15 is a bar graph identifying the top side temperature comparison of a soup cooked in the hybrid bowl of the present invention and a conventional plastic bowl.
Figure 16:
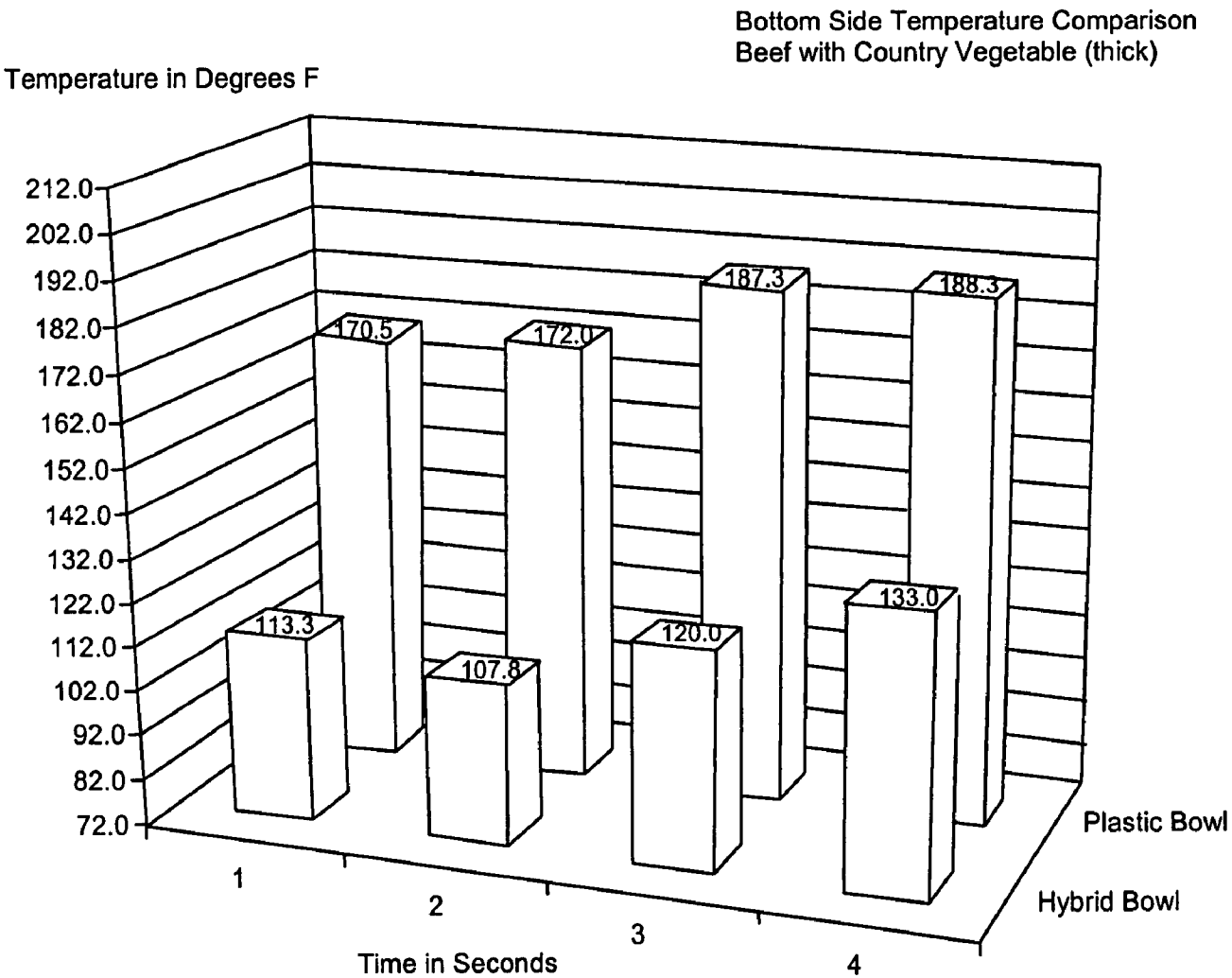
FIG. 16 is a bar graph depicting the bottom side temperature of the hybrid microwavable bowl of the present invention as compared to a conventional plastic bowl.
Figure 17:
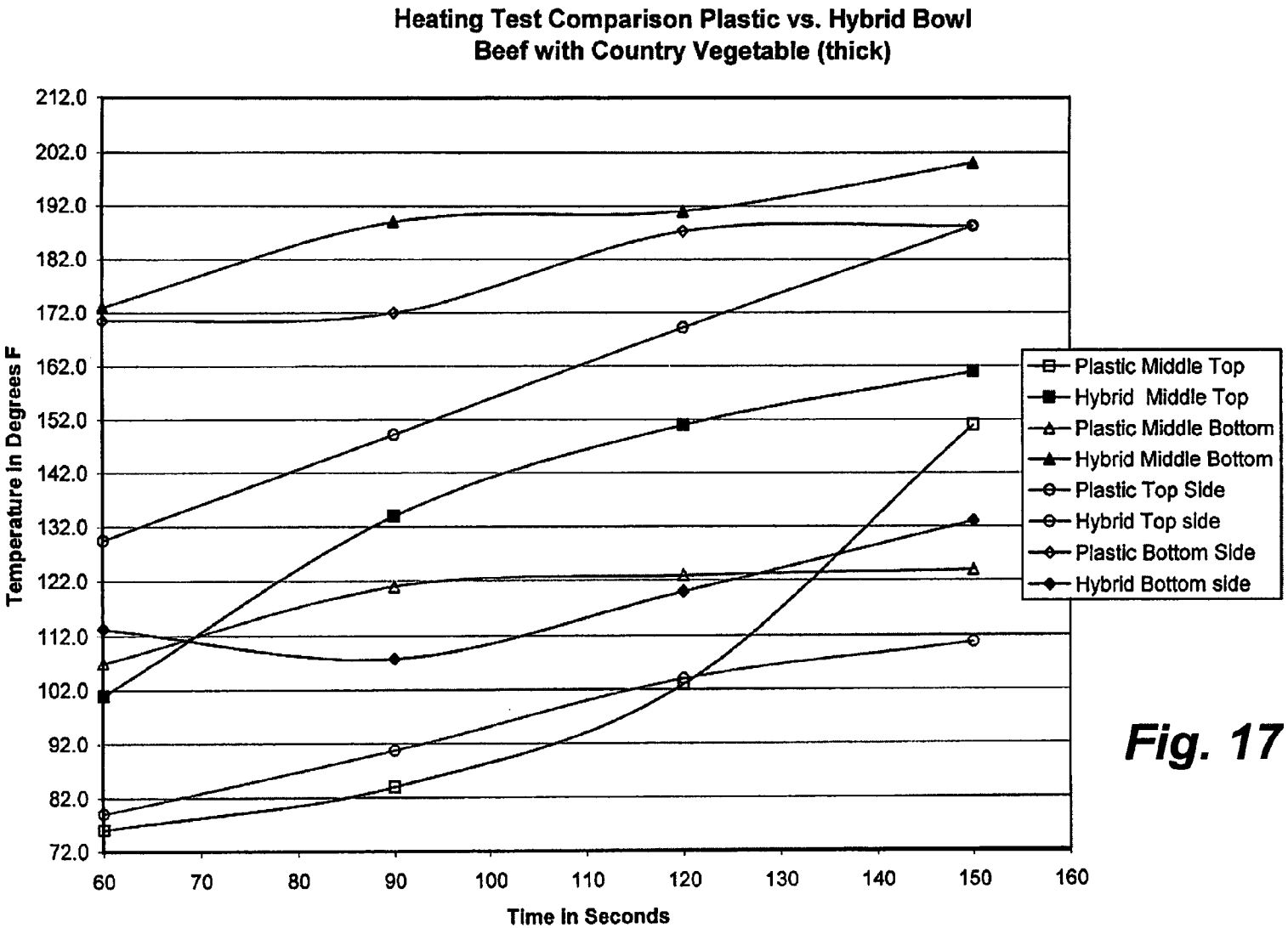
FIG. 17 is a graph depicting the temperature versus time of a soup cooked in the hybrid metal microwavable bowl of the present invention compared to a conventional plastic bowl, and identifying temperatures taken over time at the middle, top and bottom of the container.

Referring now to FIGS. 10-14, bar graphs are provided herein which summarize test data taken during development to compare the heating efficiency of the hybrid microwavable container 2 of the present invention with respect to a typical plastic or foam microwavable bowl, and more specifically a container comprised of a polypropylene EVOH thermo formed barrier sheet material. As depicted in the graphs, each of the containers were filled with a beef with country vegetable soup, and heated over a period of time up to 150 seconds at a power rating of 1100 watts. During this time period, the temperatures of the soup were taken at various positions within the containers, and the data collected and provided herein. More specifically, FIG. 10 depicts the average temperature comparison of the soup within the hybrid microwavable container 2 and the plastic bowl, while FIG. 11 represents the middle top temperature of the soup in the containers. FIG. 12 represents the middle bottom temperature, while FIG. 13 represents the top side temperature, while the bottom side temperature is depicted in FIG. 14. A line graph further depicting the comparisons between the heating in the microwavable container 2 and a typical plastic container is further shown in FIG. 15, which shows the various temperature over time in different portions of the container.

As supported by the data shown in FIGS. 10-15, the metal microwavable container 2 of the present invention is shown to have superior heating characteristics for the middle portions of the container, which is advantageous compared to typical plastic and foam microwavable containers which typically overheat the contents near the sidewall and lower portions of the container, thus causing burning of the foodstuffs contained therein, as well as potential deformation of the plastic container and an alteration in taste.

With regard to the test data used to plot FIGS. 10-15, Table 1 is provided herein, and which identifies the temperatures taken at various locations within the containers, and comparing both a conventional microwavable plastic bowl and the hybrid metallic microwavable bowl of the present invention. For example, after 60 seconds the middle bottom of the hybrid bowl has a temperature of 173° F., while a conventional plastic/foam bowl comprised of a polypropylene EVOH thermo formed barrier material has a temperature of only 107° F. Furthermore, the top side of the conventional bowl has a temperature of 163° F., as compared to the hybrid bowl of the present invention, which has a temperature of 83° F. Similar readings may be found at times of 90 seconds and 150 seconds, which clearly show the advantage of the hybrid bowl which heats from the "inside out" as opposed to the "outside-in", and thus substantially reducing the likelihood of inconsistent heating and deformation of the container along the sidewalls.

TABLE 1

| | Time (Sec) | Plastic Bowl Power = 1100 watts | Hybrid Bowl Power = 1100 watts |
|---|---|---|---|
| Top Side | 60 | 134 | 73 |
| | 60 | 137 | 94 |
| | 60 | 124 | 74 |
| | 60 | 123 | 75 |
| Average | 60 | 129.5 | 79.0 |
| Bottom Side | 60 | 181 | 112 |
| | 60 | 173 | 118 |
| | 60 | 157 | 100 |
| | 60 | 171 | 123 |
| Average | 60 | 170.5 | 113.25 |
| Middle Top | 60 | 76 | 101 |
| Middle Btm | 60 | 107 | 173 |
| Top Side | 90 | 163 | 83 |
| | 90 | 147 | 86 |
| | 90 | 141 | 91 |
| | 90 | 146 | 103.0 |
| Average | 90 | 149.3 | 90.8 |
| Bottom Side | 90 | 186 | 117 |
| | 90 | 162 | 93 |
| | 90 | 172 | 101 |
| | 90 | 168 | 120 |
| Average | 90 | 172.0 | 107.8 |
| Middle Top | 90 | 84 | 134 |
| Middle Btm | 90 | 121 | 189 |
| Top Side | 120 | 161 | 113 |
| | 120 | 178 | 102 |
| | 120 | 165 | 98 |
| | 120 | 173 | 103 |
| Average | 120 | 169.3 | 104.0 |
| Bottom Side | 120 | 200 | 137 |
| | 120 | 197 | 103 |
| | 120 | 159 | 115 |
| | 120 | 193 | 125 |
| Average | 120 | 187.3 | 120.0 |
| Middle Top | 120 | 103 | 151 |
| Middle Btm | 120 | 123 | 191 |
| Top Side | 150 | 195 | 112 |
| | 150 | 198 | 120 |
| | 150 | 177 | 108 |
| | 150 | 183 | 103 |
| Average | 150 | 188.3 | 110.8 |
| Bottom Side | 150 | 194 | 136 |
| | 150 | 198 | 146 |
| | 150 | 181 | 130 |
| | 150 | 180 | 120 |
| Average | 150 | 188.3 | 133.0 |
| Middle Top | 150 | 151 | 161 |
| Middle Btm | 150 | 124 | 200 |

For clarity, the following is a list of components and the associated numbering used in the drawings:

| # | Components |
|---|---|
| 2 | Microwavable container |
| 4 | Metal lid |
| 6 | Removable plastic lid |
| 8 | Metallic sidewall |
| 10 | Metallic sidewall upper portion |
| 12 | Metallic sidewall lower portion |
| 14 | Microwavable transparent bottom portion |
| 16 | Bottom reinforcing member |
| 18 | Peripheral edge of microwavable transparent material |
| 20 | Sealant material |
| 22 | Weld |
| 24 | Insulative material |
| 26 | Pull tab |
| 28 | Venting apertures |
| 30 | Double seam |
| 32 | Ring outer panel wall |
| 34 | Ring U-shaped countersink |
| 36 | Ring inner panel wall |
| 38 | Ring inner panel wall lip |
| 40 | Ring second end |
| 42 | Lip inner surface |

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. A metallic ring adapted for interconnection to a metallic sidewall of a microwave compatible container on a first end, and a microwave transparent material on a second end, comprising:

a substantially concentric shaped ring having a first end adapted for double seaming to a lower end of a metal sidewall of a microwave compatible container;

an outer panel wall extending downwardly from said first end;

an inner panel wall having an upper end and a lower end, said lower end interconnected to said outer panel wall to define a substantially u-shaped countersink; and a ring second end interconnected to said inner panel wall and extending inwardly, said ring second end having an upper surface and a lower surface, said upper surface adapted for interconnection to the microwave transparent material and positioned below said upper end of said inner panel wall.

2. The metallic ring of claim 1, further comprising a microwave transparent material interconnected to said upper surface of said ring second end.

3. The metallic ring of claim 2, wherein said microwave transparent material is comprised of at least one of a polypropylene, a polyethylene and EVOH material and combinations therein.

4. The metallic ring of claim 1, wherein said microwave transparent material is interconnected to said upper surface of said ring second end by at least one of an adhesive, a welding process and a double seam.

5. The metallic ring of claim 1, wherein the interconnection of said ring second end and said inner panel wall defines an upwardly extending lip.

6. The metallic ring of claim 1, wherein said substantially concentric shaped ring is comprised of an aluminum, a steel, a tin and combinations therein.

7. The metallic ring of claim 1, wherein said ring second end is elevated above a lowermost portion of said substantially u-shaped countersink a distance of at least about 0.10 inches.

8. The metallic ring of claim 1, wherein said substantially concentric ring is comprised of a continuous one piece material.

9. The metallic ring of claim 1, wherein said substantially concentric shaped ring has an outer diameter which is less than an outer diameter of an upper end of the microwave compatible container.

10. The metallic ring of claim 1, wherein said outer panel wall of said metallic ring has a height no greater than about 0.33 inches.

11. The metallic ring of claim 1, wherein said outer panel wall extends downwardly at an angle no greater than about 10 degrees from a substantially vertical plane.

12. The metallic ring of claim 1, wherein a substantially hermetic seal is created between said metal ring, the microwave transparent material and the metal sidewall.

13. The metallic ring of claim 1, wherein the substantially concentric shaped ring has a hoop strength of at least about 100 lbs.

14. The metallic ring of claims 1, wherein said substantially concentric shaped ring has a coating comprised of at least one of a polypropylene, a polyethylene, or uncoated metal material.

15. The metallic ring of claim 1, wherein said ring second end extends inwardly in a substantially horizontal plane.

16. The metallic ring of claim 1, wherein said ring second end has a length no greater than about 0.50 inches.

* * * * *